United States Patent [19]

Ito et al.

[11] Patent Number: 4,682,158

[45] Date of Patent: Jul. 21, 1987

[54] GUIDANCE DEVICE FOR MANIPULATION OF MACHINE

[75] Inventors: Masaji Ito, Ageo; Akira Midorikawa, Yokohama; Masayuki Shinada, Yokohama; Tatsuo Hirono, Yokohama; Hirobumi Yoshino, Tokyo; Mitsuo Shibusawa, Yokohama, all of Japan

[73] Assignee: Ricoh Company, Ltd., Tokyo, Japan

[21] Appl. No.: 724,162

[22] Filed: Apr. 17, 1985

[30] Foreign Application Priority Data

| | | | |
|---|---|---|---|
| Apr. 18, 1984 | [JP] | Japan | 59-57173 |
| Apr. 18, 1984 | [JP] | Japan | 59-57174 |
| Apr. 18, 1984 | [JP] | Japan | 59-57175 |
| Apr. 19, 1984 | [JP] | Japan | 59-78847 |
| Apr. 27, 1984 | [JP] | Japan | 59-85881 |
| Apr. 27, 1984 | [JP] | Japan | 59-85882 |
| Apr. 27, 1984 | [JP] | Japan | 59-85883 |
| Jun. 21, 1984 | [JP] | Japan | 59-126431 |
| Jun. 22, 1984 | [JP] | Japan | 59-127536 |
| Jul. 3, 1984 | [JP] | Japan | 59-136637 |

[51] Int. Cl.[4] ..... G08B 21/00

[52] U.S. Cl. ..... 340/679; 355/14 C; 355/133; 340/691; 364/185

[58] Field of Search ..... 355/14 C, 133; 364/185, 364/186; 340/679, 691

[56] References Cited

U.S. PATENT DOCUMENTS

| | | | |
|---|---|---|---|
| 4,496,237 | 1/1985 | Schron | 355/14 C |
| 4,500,971 | 2/1985 | Futaki et al. | 355/14 C |

OTHER PUBLICATIONS

Multimate International Corp., "Multimate Reference Manual," pp. R-1-61-R-1-62, East Hartford, CT, 1983, 1984.

Barnes, Kate, *Using Multimate*, pp. 20-21, Que Corp., Indianapolis, Ind. 1985, LC 84-60141.

*Primary Examiner*—Glen R. Swann, III

*Attorney, Agent, or Firm*—Oblon, Fisher, Spivak, McClelland & Maier

[57] ABSTRACT

A machine has a control panel with a plurality of keys controlling various functions. A display exhibits prompts as to the proper operation of the machine. An operator can learn the functions of the keys by manipulating them and observing the resulting prompts. The display additionally exhibits maintenance and (in a diagnostic mode) diagnostic prompts. Sensors respond to various maintenance or diagnostic conditions. Signals from the sensors cause a storage means to supply corresponding prompts to the display to prompt the needed maintenance or diagnostic procedure. When the appropriate procedure has been performed, additional prompts for subsequent procedures will be displayed if appropriate.

4 Claims, 52 Drawing Figures

FIG.27

23°C 60%

52

FIG.28

5°C 30%
DO NOT USE
FEAR OF CONTAMINATION
OF BACKGROUND

OPERABLE TEMPERATURE
AND HUMIDITY
10°C~30°C 30%~90%
TO USE, PRESS CANCEL KEY

52

FIG.29

28°C 91%
DO NOT USE
FEAR OF SHEET JAM .

OPERABLE TEMPERATURE
AND HUMIDITY
10°C~30°C 30%~90%
TO USE, PRESS CANCEL KEY

52

GUIDANCE DEVICE FOR MANIPULATION OF MACHINE

BACKGROUND OF THE INVENTION

The present invention relates to a device for controlling a machine, or apparatus, which serves multiple functions and includes numerous keys to be manipulated by an operator. More particularly, the present invention relates to a guidance device for promoting efficient use of a machine, such as an electrophotographic copier, facsimile apparatus or similar business machine, by adding a display to a control panel of the machine and, thereby, displaying various guidances or prompting for the operation of the machine in characters and/or graphs in response to manipulation of desired keys.

In modern business machines such as copiers, facimile apparatuses and printers, it is a common practice to install a microcomputer and a control panel which is provided with numerous keys for fulfilling various functions, the keys being selectively operable to condition the apparatus for a desired mode of operation. Difficulty, however, has been encountered for an ordinary unspecified person to have through knowledge of the functions assigned to the numerous keys and to be able to master the apparatus. For example, although operations usually involved in the maintenance of an electrophotographic copier as typified by the supply of expendables and removal of paper jams are relatively simple, they are not frequently performed and, hence, it is more difficult than expected for an ordinary person to complete such operations quickly and accurately by manipulating particular keys necessary. That is, since modern copiers are designed to allow any expendable such as sheets or toner to be loaded in a relatively large amount at a time and the frequency of copy sheets and documents jamming their transfer paths is relatively low, an ordinary person cannot easily accomplish even such a relatively simple operation accurately and quickly by freely operating some of the numerous keys on the control panel.

Measures heretofore contemplated to overcome the above situation are simply business-minded, e.g. providing oral instructions or a complete set of operation manuals or placing printed matters such as decals to machines. Such measures make it difficult to teach unspecified persons through understanding of the necessary procedures.

Thus, there is a growing demand for an implementation which helps any unspecified person easily acquire various kinds of knowledge associated with a machine on a semi real-time basis by actually operating the machine, thereby eliminating the need for positive implementations such as using printed matters for explanation or the need for trained instructors.

SUMMARY OF THE INVENTION

It is therefore an object of the present invention to provide a guidance device for the manipulation of a machine which is furnished with numerous keys and a display for allowing any person to easily operate the machine, to which various functions are assigned.

It is another object of the present invention to provide a guidance device for the operation of a machine which allows any person to master the operation on a real-time basis by actually manipulating the machine.

It is another object of the present invention to provide a generally improved guidance device for the manipulation of a machine.

In accordance with one aspect of the present invention, there is provided a guidance device for manipulating a machine having multiple keys to which various functions are assigned. The device comprises a first key for specifying an operation of the machine, a display for displaying guidance representing of a function assigned to this first key, a second key for specifying display of the guidance, a store or memory for storing display data representative of the guidance, and a control for controlling the display and store in response to manipulation of the first and second keys. The control is constructed to, when the first key is manipulated after the second key, read the display data associated with the first key out of the store and, based on the display data read out, displays on the display the guidance representative of the function of the first key.

In accordance with another aspect of the present invention, there is provided a guidance device for manipulating a machine having multiple keys to which various functions are assigned. The device comprises a first sensor for sensing a condition in which the machine needs a maintenance operation, a second sensor for sensing a mounted condition of a movable element included in the machine, a display for displaying guidances which specify a procedure of the maintenance operation, a store for storing display of the guidances associated with the first sensor, and a control for controlling the store and display in response to outputs of the first and second sensor. The control unit is constructed so that when the first sensor senses the condition of the machine, the control unit reads out the display of the guidance messages associated with the condition out of the store, it then displays the guidances on the display and, thereafter, sequentially read out display of the guidances associated with the second sensor to display the guidances on the display in response to an output of the second sensor.

In accordance with another aspect of the present invention, there is provided a guidance device for manipulating a machine having multiple keys to which multiple functions may be assigned. The device comprises a first specifying element for specifying a mode in which a portion or section of the machine is to be diagnosed, a second specifying element for specifying a portion to be diagnosed in a specified mode, a control for diagnosing a condition of the portion specified by the second specifying element, and a display controlled by the control for displaying maintenance information. The control is constructed to, when the first specifying element is manipulated, diagnose the portion specified by the second specifying element to display maintenance information associated with that portion or section on the display.

The above and other objects, features and advantages of the present invention will become more apparent from the following detailed description taken with the accompanying drawings.

BRIEF DESCRIPTION OF THE DRAWINGS

FIGS. 27–29 are views representative of exemplary prompts appearing on a CRT and associated with the controller of FIG. 26;

DESCRIPTION OF THE PREFERRED EMBODIMENTS

While the guidance device for the manipulation of a machine of the present invention is susceptible of numerous physical embodiments, depending upon the environment and requirements of use, substantial numbers of the herein shown and described embodiments have been made, tested and used, and all have performed in an eminently satisfactory manner.

Although the present invention will be described focusing to an electrophotographic copier, such is only illustrative and the present invention is naturally applicable to any other kind of machines. The copier to which the present invention is applicable is assumed to be of the type which includes an automatic document feeder or (ADF) and is capable of two-sided copying although a detailed description of its construction and operation will be omitted (for clarity).

Figure 1:
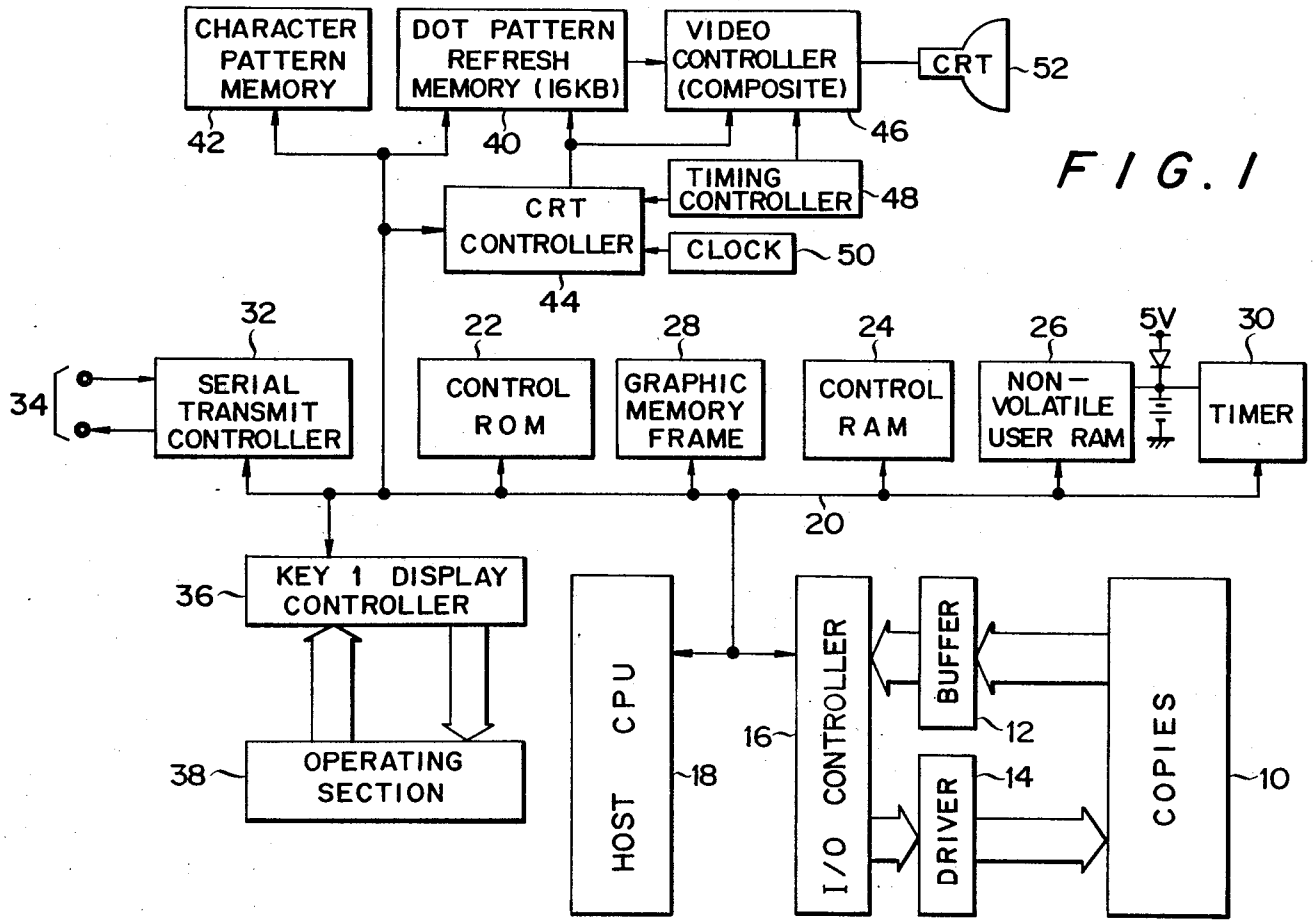
FIG. 1 is a block diagram of a guidance device embodying the present invention which is applied to a copier.

Referring to FIG. 1 of the drawings, a guidance device embodying the present invention is shown. The basic copier mechanism, 10, is electrically connected to a host central processing unit (CPU) 18 via a buffer 12, a driver 14, and an input/output (I/O) controller 16. The copier 10 is constructed to optically scan a document to form an electrostatic latent image thereof on a photoconductive element, develops the latent image by means of a toner, transfers the resulting toner image to a plain paper or like recording medium, and fixes the toner image on the recording medium. As described above, in this particular embodiment, the copier 10 includes an ADF.

As shown, the CPU 18 is interconnected by a system bus 20 to a control read only memory (ROM), a control random access memory (RAM) 24, a non-volatile user RAM 26, a graphic memory frame 28, a timer circuit 30, a serial transmission controller 32, etc. A transmission line 34 may be interconnected to the serial transmission controller 32. The CPU 28 is also interconnected to an operating or control section 38 by way of a key/display controller 36. The operating section 38 is adapted to allow an operator to instruct the device inclusive of the copier 10 to perform a particular operation while displaying a device condition or a mode, as will be described later in detail.

Figure 2:
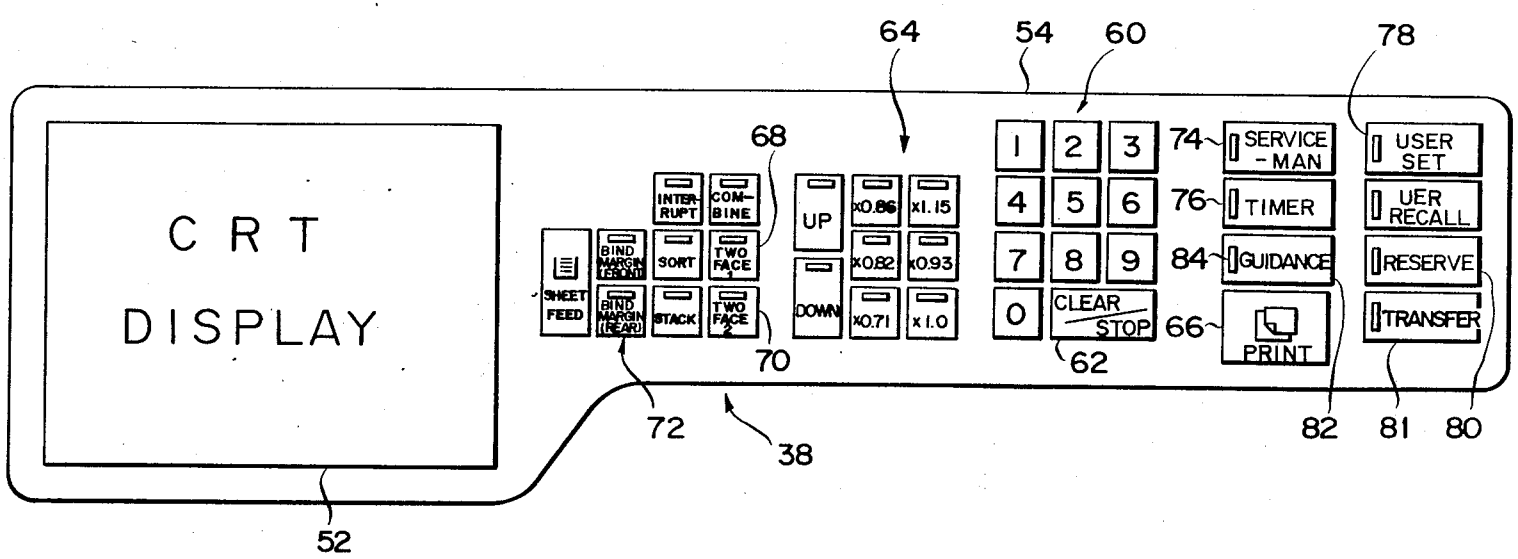
FIGS. 2 and 3 are views representative of exemplary configurations of a control panel in accordance with the embodiment of FIG. 1.

Also interconnected to the bus 20 are a dot pattern refresh memory 40, a character pattern memory 42 and a CRT controller 44. These elements provide the display control associated with a CRT 52 in cooperation with a video control section 46, a timing controller 48 and a clock generator 50, thereby completing a graphic display capable of displaying information in the way of characters and/or graphs. As shown in FIG. 2, the CRT 52 forms part of the operating section 38.

Figure 3:
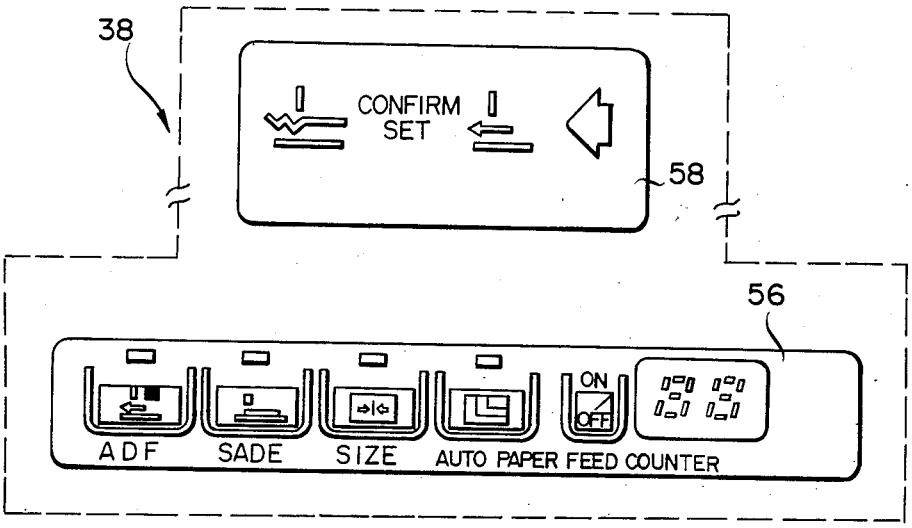

As shown in FIGS. 2 and 3, the operating section 38 in this particular embodiment comprises three control and display panels 54, 56 and 58. Arranged on the control and display panel 54 are multiple keys for controlling the operation of the copier 10, and the CRT for displaying information associated with the key operations. Arranged on the control and display panels 56 and 58 are keys for displaying the operation of the ADF, and a display for displaying information associated with the key operations. Specifically, the panel 54 includes at least ten keys 60 for setting a desired number of copies, a clear/stop key 62, magnify keys 64 for setting up various magnifications, a print start key 66, a both-face 1 key 68 for copying one-faced documents on both faces of transfer sheets, a both-face 2 key 70 for copying double-faced documents on both faces of transfer sheets, a binding margin key 72 for leaving a blank or nonimage area of selected dimensions as a binding margine at the front or rear end or the right or left end of a transfer sheet, a serviceman key 74 to be operated by a serviceman to display information necessary for the maintenance of the copier 10, a timer key 76 for driving the timer circuit 30 to controllably turn on and off a power supply of the copier 10, a user set key 78 to manipulated by a user to enter desired data into the RAM 26, a reserve key 80 for allowing one to use suitable one of a plurality of interlinked copiers based on the operating conditions of the copiers, and a transfer key 81. These keys are manipulated either singly or in combination, while information associated with the manipulation is displayed on the CRT 52, thereby realizing a variety of functions with the copier 10.

That is, such various functions are selectively specified by an operator through the various keys shown in FIGS. 2 and 3 and the CPU 18 controls the various sections of the device to execute the desired functions.

A prerequisite for any person to sufficiently deal with such various functions is that he or she fully knows the functions assigned to the respective keys. In this particular embodiment, prompts are provided teaching the usage of the keys are selectively displayed on the CRT 52 in response to manipulation of the keys. This mode of operation will be referred to herein as a guidance mode, as distinguished from a copy mode and possible modes. The guidance key 82 is provided as shown in FIG. 2 in order to switch the device to the guidance mode from any other mode or to reset it from the guidance mode. Upon manipulation of the guidance key 82, the CPU 18 senses it via the controller 36 and turns on a light emitting element 84 associated with the key 82. The CPU 18 regards any subsequent keying operation as a request for the guidance display and, in response to the keying operation, causes the CRT 52 to display a function assigned to the pressed keys.

Hereinafter will be described some examples of the guidance display in accordance with the present invention.

(I) Two-face copy guidance display

As previously mentioned, the copier 10 in the illustrative embodiment is selectively operable in two different two-face copy modes, i.e., a two-face 1 copy mode assigned to the key 68 and a two-face 2 copy mode assigned to the key 70. In an ordinary copy mode operation, when the two-face 1 key 68 is depressed, images on one face of a plurality of documents are sequentially reproduced on both faces of transfer sheets. More specifically, the CPU 18 controls the ADF of the copier 10 such that a one-faced document sheet is fed to a scanning station to reproduce its replica on one face of a transfer sheet and, then, the copy sheet is placed upside down to reproduce a replica of the next one-faced document sheet on the other face of the copy. During the latter part of the procedure, the CPU 18 delivers an image shift instruction to the copier 10 such that a "binding margin", which will be about 5 millimeters, may be left at one side of the copy sheet. In response to this instruction, the copier 10 activates a registration device for the binding margine adjustment, thereby shifting images on the other side of the copy sheet.

As the two-face 2 key 70 is depressed in the ordinary copy mode operation, both faces of a document sheet are reproduced one on each face of a transfer sheet. More specifically, the CPU 18 controls the ADF of the copier 10 to feed a double-faced document sheet to the scanning station to replicate a picture on one face of the document on a transfer sheet and, then, both the document sheet and the transfer sheet are inverted to reproduce the other face of the document on the other face of the copy sheet. In this instance, the registration device assigned to binding margin adjustment is not activated.

Figure 4:
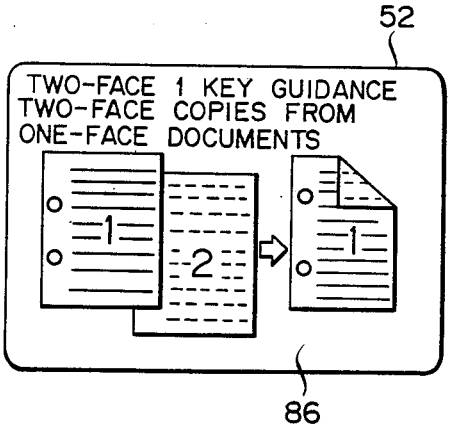
FIGS. 4 and 5 are views representative of exemplary guidances appearing on a display included in the control panel of FIG. 2.

Upon depression of the guidance key 82, the CPU 18 controls the device of the invention as follows in response to the manipulation of, for example, the two-face 1 key 68 or the two-face 2 key 70. For example, when the key 68 is depressed, the CPU 18 senses it via the controller 34 and causes the CRT 52 to display a two-face 1 copy guidance prompt 86 as shown in FIG. 4. In this particular embodiment, that pictures on one-faced documents are to be copied on both faces of transfer sheets is indicated by the characters and graphs shown. This allows the operator to grasp the function assigned to the key 82 quickly and accurately.

Figure 5:
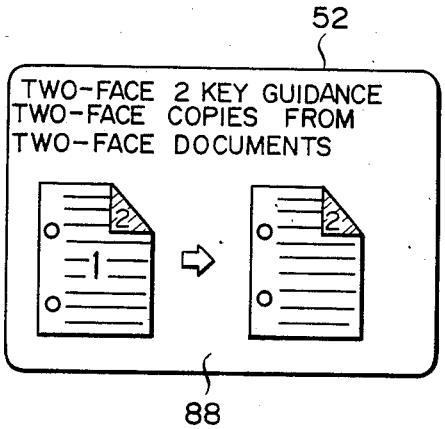

Upon depression of the two-face 2 key 70, for example, the CRT 52 will cause the CRT 52 to display a two-face 2 copy guidance display 88 as shown in FIG. 5. In the illustrative embodiment, the guidance 88 shows in characters and graphs that images on both surfaces of document sheets are to be reproduced on both faces of transfer sheets. The operator will then see the function assigned to the key 70 quickly and accurately. Such a guidance display function applies not only to the keys 68 and 70 but also to the other keys of the device of the present invention.

In this particular embodiment, image data for providing the guidance displays 86 and 88 and others are semi-permanently stored in the graphic memory frame 28. Taking the two-face 1 key 68 for example, when it is depressed, the CPU 18 reads image data representative of the guidance display 86 out of the memory 28 and, then, an image display pattern associated with the image data out of the character pattern memory 42 so as to generate dot patterns. The dot patterns are stored in the refresh memory 40. Timed to the timing controller 48 and clock generator 50, the CRT controller 44 sequentially retrieves the dot patterns from the refresh memory 40, while the video controller 46 converts them into a composite video signal. Finally, the composite video signal is sent to the CRT 52 to appear as the guidance display 86.

As described above, when any of the keys which are assigned to individual functions in a usual mode operation is depressed after the depression of the guidance key 82, a guidance indicative of a function assigned to the particular key is provided on the CRT 52.

(II) Copier maintenance guidance display

Figure 6:
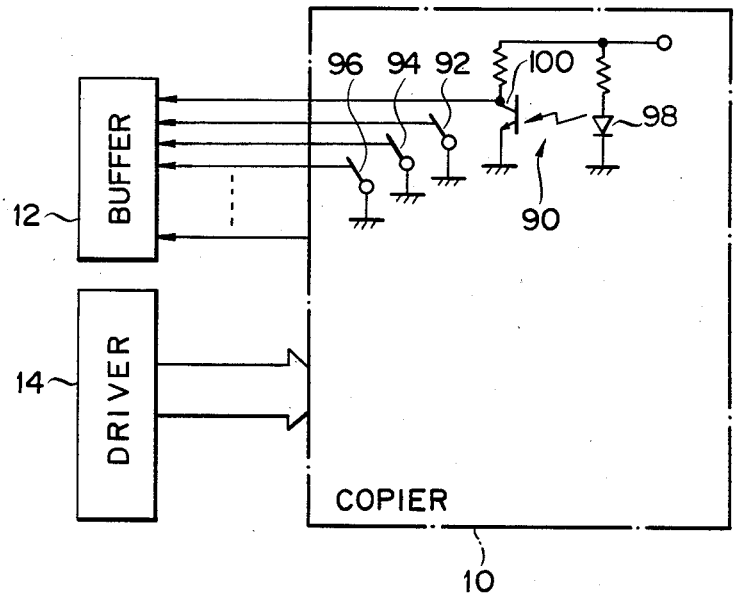
FIG. 6 is a diagram of a jam sensor included in the copier shown in FIG. 1.
Figure 7:
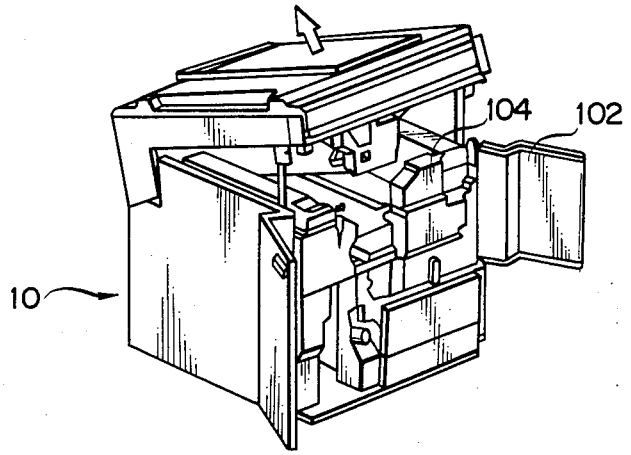
FIG. 7 is an external view of the copier to which the embodiment of FIG. 1 is applied.

As shown in FIG. 6, the copier 10 is equipped with a jam sensor 90 and switches 92, 94 and 96 whose are commonly interconnected to the buffer 12. In this particular embodiment, the jam sensor 90 comprises a light emitting element 98 and a phototransistor 100 which are arranged at opposite sides of a sheet transport path in a sheet inverting section of the copier 10, which will be discussed later. Light issuing from the light emitting element 98 toward the phototransistor 100 will be interrupted by a transfer sheet which is being fed through the sheet transport path. The output of the phototransistor 100 is read by the CPU 18 via the buffer 12 and I/O controller 16. If the interruption of the light by a transfer sheet continues over a substantial period of time, the CPU 18 determines that the sheet has jammed the sheet transport path. Assuming by way of example, that a sheet jam has occurred in the copy sheet inverting section in a two-face copy mode, as shown in FIG. 7, the copier 10 is constructed such that its front right door 102 is openable to pull a fixing and inverting unit 104 toward an operator. Opening the door 102 opens the switch 92 which is electrically connected to the door 102. Meanwhile, pulling the unit 104 out of the copier 10 separates a connector which is adapted to secure electrical connection of the unit 104 with the other sections of the copier 10, whereby the switch 94 is opened.

Figure 8:
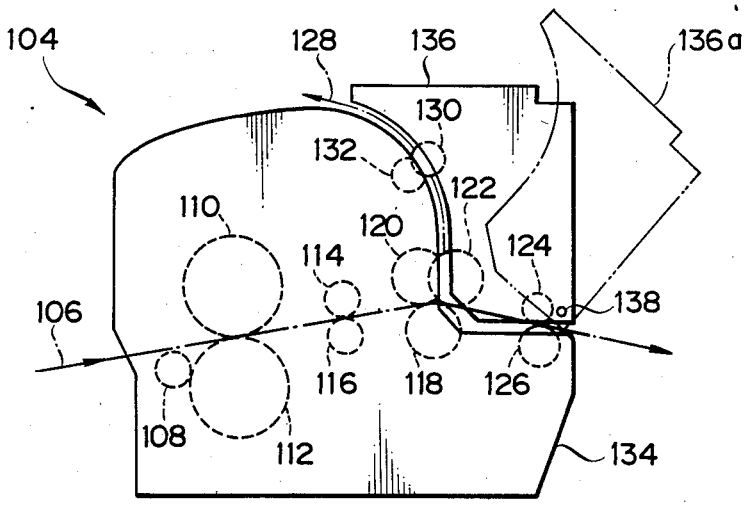
FIG. 8 is a side elevation showing an external view of a fixing and inverting unit built in the copier of FIG. 7.

As shown in FIG. 8, the fixing and inverting unit 104 includes a cleaning roller 108, a fixing roller 110, a pressing roller 112, rollers 114 and 116, an inverting roller 118, inverting rollers 120 and 122, and discharge rollers 124 and 124, all of which are arranged sequentially along a sheet transport path 106. Details of such an arrangement are not directly relevant to an understanding of the present invention and, therefore, their description will be omitted.

The fixing and inverting unit 104 is made up of a lower subunit 134 and an upper subunit 136 which are separable from each other at the sheet transport path in an inverting section. Specifically, as indicated by a dash-and-dots line 136*a* in FIG. 8, the upper subunit 136 is movable away from the lower subunit 134 about a fulcrum 138 so as to make the sheet transport path 128 freely accessible from the outside. With such a separable configuration, the unit 104 will allow one to readily remove a jamming sheet from the sheet transport path 128. In this particular embodiment, opening the subunit 136 as described opens the switch 96.

Figure 9:
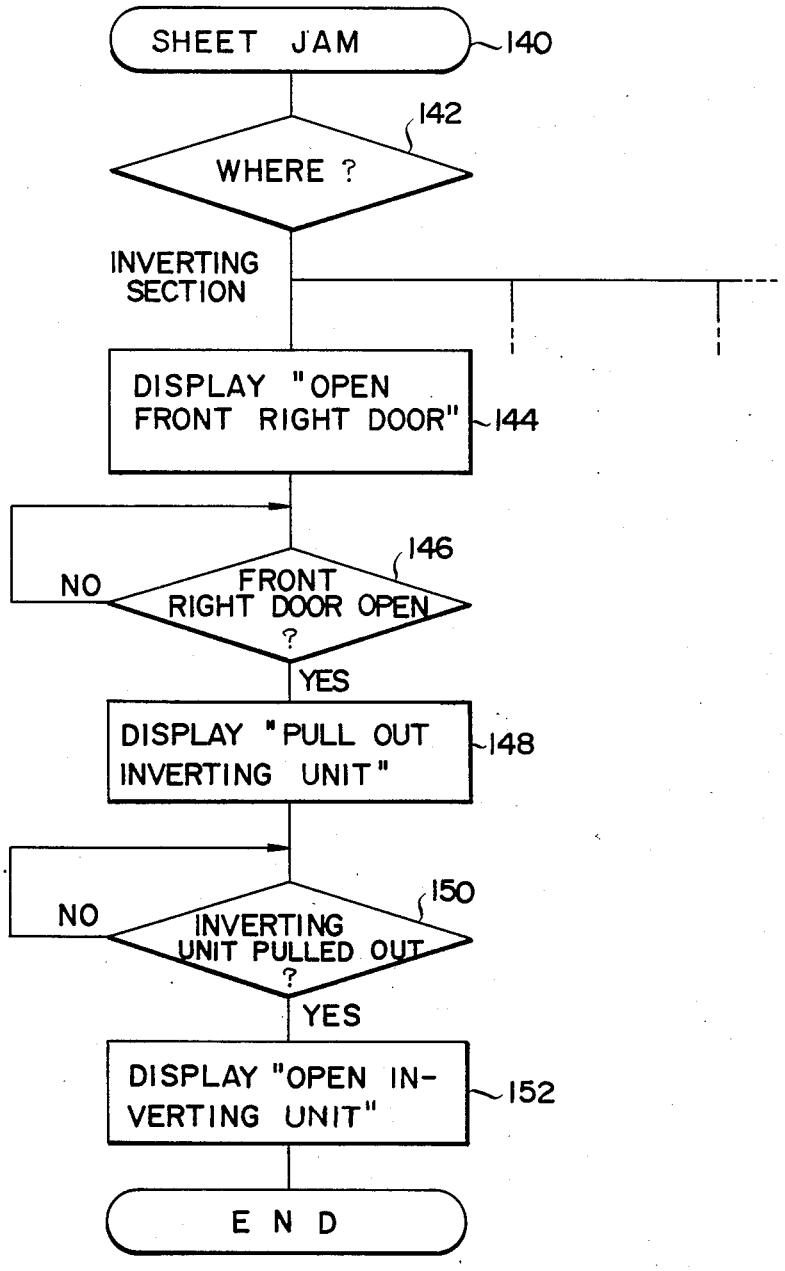
FIG. 9 is a flowchart outlining a control over a guidance display associated with a maintenance mode, for example the removal of a jammed sheet in accordance with the illustrative embodiment.
Figure 10:
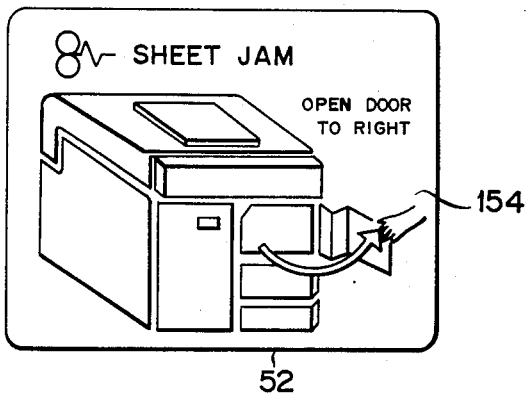
FIGS. 10–12 are views representative of exemplary prompts which appear on a cathode-ray tube (CRT) in a maintenance mode in accordance with the illustrative embodiment.

Assume that a sheet has jammed the inverting path 128 (140 in FIG. 9). Then, the CPU 18 senses the sheet jam via the jam sensor 90 and, as it identifies the particular location of the sheet jam (142), the CPU 18 causes the CRT 52 to provide a display 154 as shown in FIG. 10 (144). While the display 154 shows that a sheet jam has occurred and an instruction for urging the operator to open the front right door 102 is provided. It may also indicate that the location of the sheet jam is in the inverting section.

Figure 11:
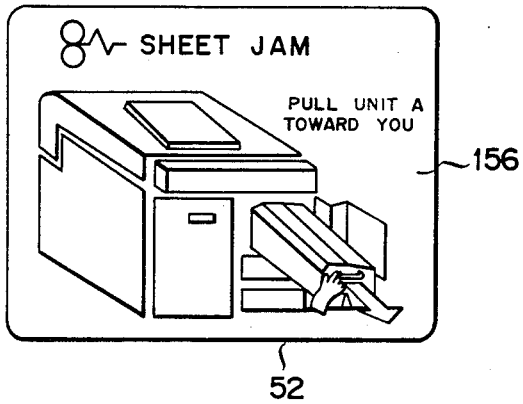
Figure 12:
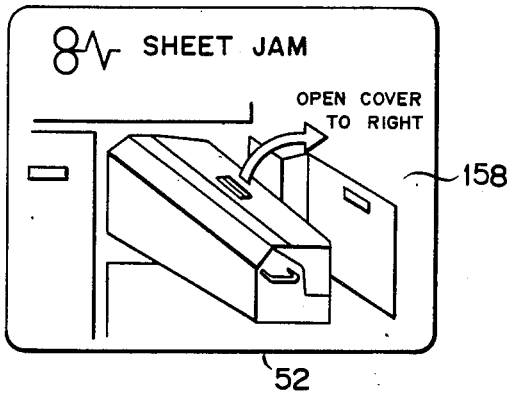

As the operator opens the door 102 according to the display 154, the CPU 18 senses the resulting opening of the switch 92 (146) and, then, produces a display 156 shown in FIG. 11 on the display 52. The display 156 shows the occurrence of a sheet jam and an instruction for urging the operator to pull out the unit 104 toward him or her. When the operator pulls out the unit 104 as instructed, the CPU 18 senses the consequent opening of the switch 94 and causes the CRT 52 to provide a display 158 shown in FIG. 12 (152). The display 158 shows the occurrence of a sheet jam and an instruction for opening the upper or inverting subunit 136. The transport path 128 is now free to access for removing the jamming sheet.

As shown in the flowchart of FIG. 9, the guidance display sequence may be terminated at the just mentioned stage. If desired, however, further steps may be programmed in order to sequentially provide on the CRT 52 guidances for restoring the machine to normal. For example, an arrangement may be made such that, when the subunit 136 is opened, the CPU 18 sensing the resulting opening of the switch 96 displays a message for instructing the operator to remove the jamming sheet and, as the output of the jam sensor 90 indicates removal of the jammed sheet, a message instructing to return the subunit 136 to its original or operative position and, as the subunit 136 is so returned closing the switch 96, a message instructing to push the unit 104 into the copier 10 and, as the unit 104 is so pushed closing the switch 94, a message is provided instructing the operator to close the door 102.

The guidance key 82 provided on the control panel 38 as shown in FIG. 2 may serve as a key for causing the CRT 52 to display any desired manipulation guidance. Specifically, in such an alternative arrangement, the CPU 18 upon depression of the guidance key 52 senses this depression via the controller 36 and turns on the light emitting element 84. At the same time, the CPU 18 causes the CRT 52 to provide guidance displays associated with maintenance work which may be entered through the ten keys 60 in codes. For example, when a particular code representative of a sheet jam at the inverting section is entered, the CRT 52 will sequentially provide the guidance displays 164, 156 and 158 (FIGS. 10–12) which guide the operator in removing a sheet jam in the inverting section as previously described. In this manner, after the guidance key is depressed, a code specifying a particular failure may be entered through the ten keys 60 to see guidances on the display 52 which are associated with maintenance work for removing the failure.

In this particular embodiment, video data for displaying the guidance displays 154, 156 and 158 are semipermanently stored in the graphic memory frame 28. Taking the sheet jam in the inverting section for example, as it is sensed, the CPU 18 responds to it by reading video data representative of the guidance display 154 out of the memory 28 and, then, an image display pattern associated with the video data out of the character pattern memory 42 to thereby generate dot patterns. The dot patterns are stored in the refresh memory 40. Timed to the timing controller 48 and clock generator 50, the CRT controller 44 sequentially reads out the dot patterns out of the refresh memory 40 and converts them to a composite video signal which then appears on the CRT 52 as the guidance display 154.

The description of the illustrative embodiment has so far focused to the jam sensor 90 and the switches 92, 94 and 96. It should be noted, however, that other various sensors responsive to predetermined failures and switches responsive to mounting conditions of movable members are installed in the copier 10. Such a concept is advantageously applicable to maintenance operations which will be described by way of example.

The maintenance operations mentioned above may be by example be in response to the lack of supply of sheets in a paper tray in response to a paper end signal, the need for replacement of a toner cartridge in response to a toner end signal, the need to re-supply silicone oil for a fixing unit in response to a separating slicone oil end signal, the need for replacement and disposal of a toner collector bottle in response to sensing of its full state, the need for cleaning or replacement of charging and discharging corona discharge wires in response to increment of a copy counter to a predetermined count or a measured discharge the need for current, replacement of a photoconductive element unit in response to a counted copy number, or the need for replacement of a color developing unit using one color with a developing unit using another color in response to manipulation of the guidance key 82.

It will be seen from the above that, although difficulty has been experienced in providing ordinary persons with a through knowledge of maintenance operations associated with, for example, sheet jams which rarely occur, the embodiment shown and described allows any person to adequately acquire the necessary knowledge to conduct maintenance operations, as guided by displays which sequentially appear on the CRT 52 by following the consecutive steps of trouble shooting.

(III) Serviceman's maintenance guidance display

As shown in FIG. 2, the illustrative embodiment includes the ten keys 60 which may be used in a usual copy made operation for the purpose of setting a desired number of copies. In accordance with this particular embodiment, the ten keys 60 are also used to enter a maintenance code for specifying a particular portion inside the copier 10 to be measured in a maintenance or diagnosis mode operation.

As previously stated, the guidance device includes the serviceman key 74 in addition to the keys for use in the usual copy mode such as the print start key 66. When the serviceman key 74 which is adapted to specify a "maintenance mode" is depressed, maintenance information related to a particular portion specified through the ten keys 60 will appear on the CRT 52 or its hard copy will be produced by the copier 10. In this particular embodiment, the maintenance information may include a specified kind of maintenance of each part constituting a copier, i.e., part to be measured, its operation, adjustment and failure conditions, as well as times of adjustment and replacement.

While the serviceman key 74 is shown in this particular embodiment as being located on the panel 54 of the control section 38, it may alternatively be located within the device such as on a circuit board of the CPU 18. Located inside the device, the serviceman key 74 would be safeguarded against careless manipulation by persons other than servicemen.

Figure 13:
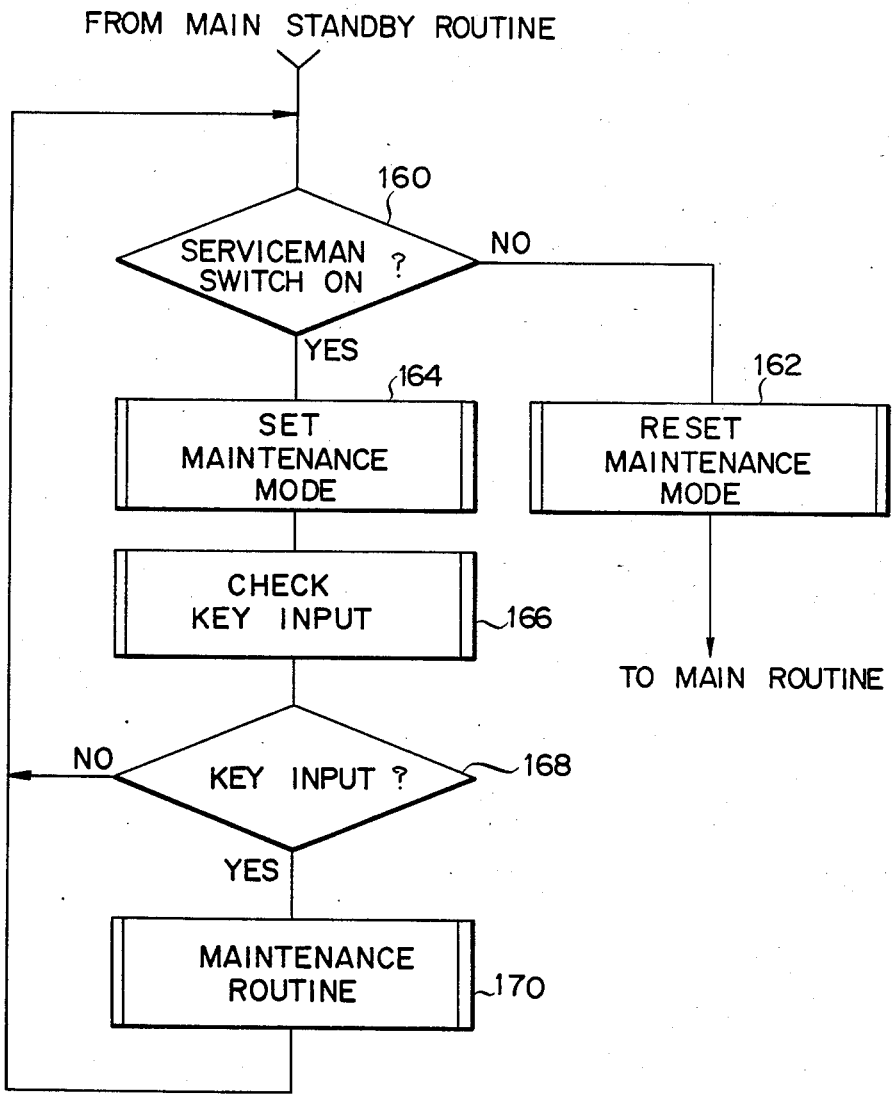
FIGS. 13–15 and 19 are flowcharts showing guidances in a maintenance mode which may be set up by a serviceman in accordance with the illustrative embodiment.
Figure 14:
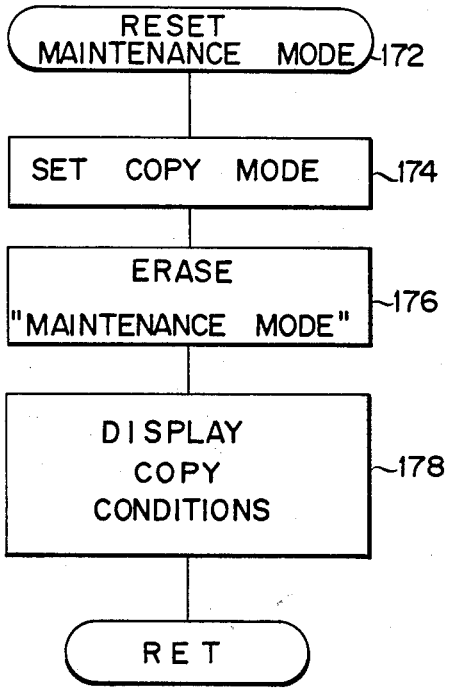
Figure 16:
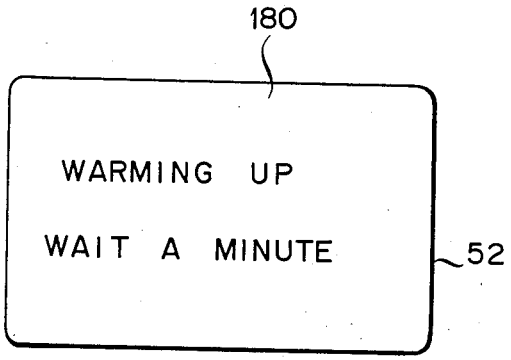
FIGS. 16, 17, 20 and 21 are views representative of examples of instructions and maintenance information appearing on a CRT in a maintenance mode set up by a serviceman in accordance with the illustrative embodiment.

So long as the serviceman key 74 for setting up a maintenance mode is not depressed, the CPU 18 circulates through a main routine by way of steps 160 and 162, as shown in FIG. 13. At maintenance mode reset 162, the CPU 18 delivers a copy mode instruction to the copier 10 and the like (174) while turning off the display of a maintenance mode (176), as shown in FIG. 14. Then, the CPU 18 indicates a condition of the copier 10 on the CRT 52. For example, if various sections of the copier 10 are in a warm-up period after the power supply has been turned on, a display 180 shown in FIG. 16 will appear on the CRT 52. This facilitates operator's understanding of the operating mode and conditions of the copier 10. Details of the displaying procedure will be later described.

Upon depression of the serviceman key 74, the CPU 18 senses this depression via the controller 36 (160) and turns on a light emitting diode 84 for confirmation of this fact. Thereafter, the CPU 18 regards an input through the ten keys 60 not as a desired number of copies but rather as a maintenance code and, in response to this code, runs a diagnosis program for a portion associated with the code, thereby checking for a failure, measuring a condition, or performing any other desired maintenance work.

Figure 15:
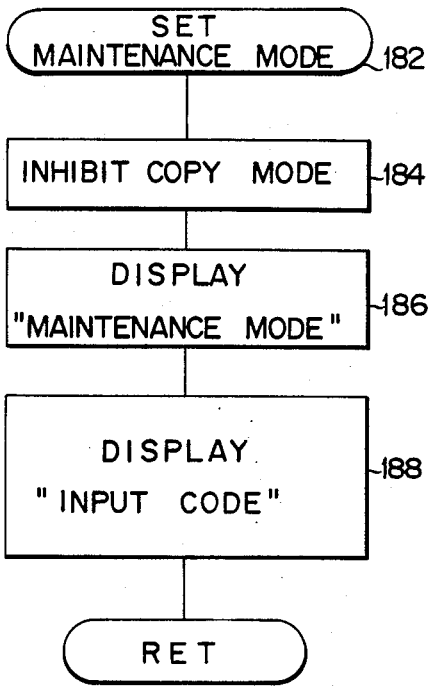
Figure 17:
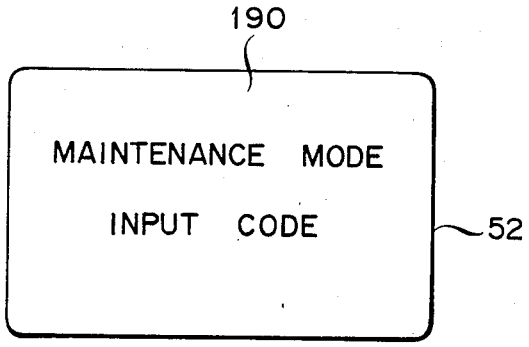

In detail, the CPU 18 conditions the system for a maintenance mode (182 in FIG. 15) and, then, turns on a display "maintenance mode" (186). As a result, in this particular embodiment, a guidance display 190 shown in FIG. 17 appears on the CRT 52 (188). According to an instruction "input code" in the guidance display 190, the serviceman manipulates the ten keys 60 to enter a maintenance code.

Figure 18:
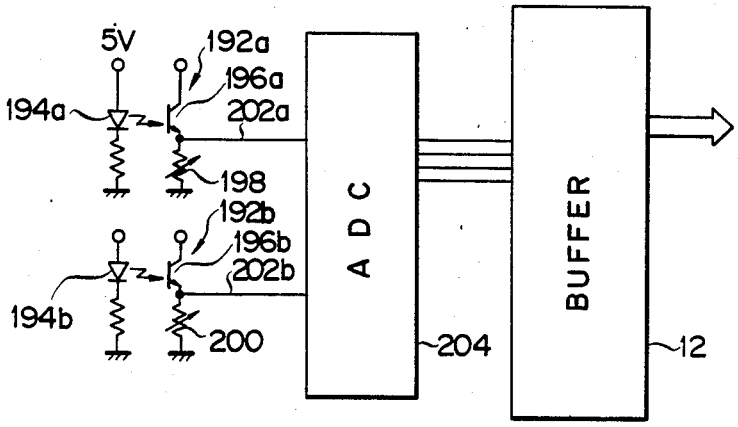
FIG. 18 is a functional block diagram showing another specific construction of the jam sensor in accordance with the illustrative embodiment.

As previously stated, the copier 10 includes a jam sensor such as shown in FIG. 6. The following description will proceed on the assumption that a plurality of jam sensors **192*da* and 192*b* (named "jam sensor A" and "jam sensor B") such as shown in FIG. 18 are arranged along a sheet transport path. For example, as shown in FIG. 18, light emitting diodes 194*a* and 194*b* and phototransistors 196*a* and 196*b* are positioned in facing relation at opposte sides of a sheet transport path. Variable resistors 198 and 200 respectively are associated with the jam sensors 192*a* and 192*b* in order to adjust the bias of the phototransistors 196*a* and 196*b***. Jams may be sensed either by a transmission type system or a reflection type system.

The outputs **202*a* and 202*b* of the phototransistors 196*a* and 196*b* are applied to an analog-to-digital converter (ADC) to be thereby converted to digital data. The digital data indicative of output voltages of the transistors 196*a* and 196*b* are routed to the CPU 18 by way of the input buffer 12**.

Figure 19:
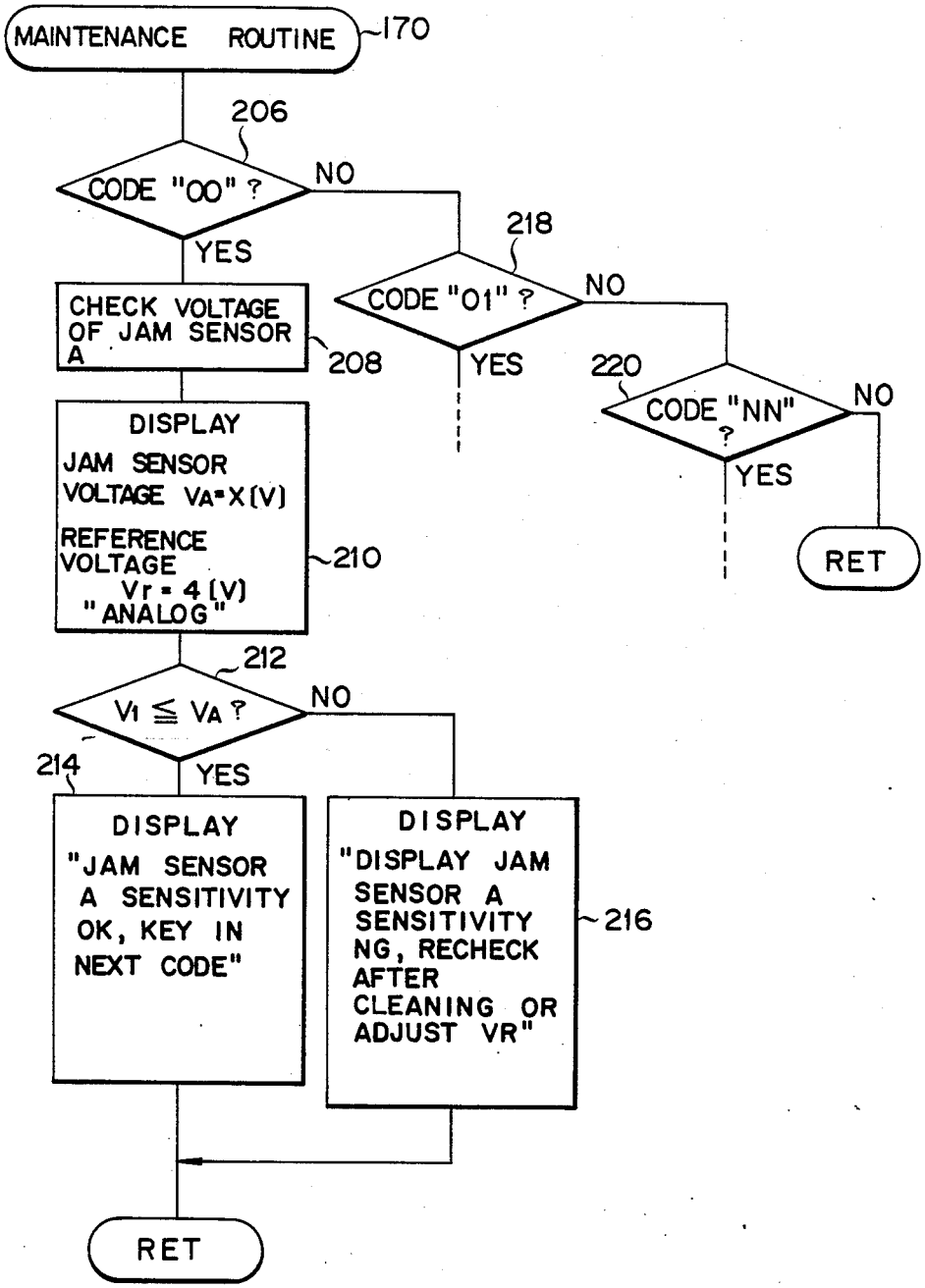

For example, when a maintenance code "00" specifying the jan sensors **192*a* and 192*b* is entered through the ten keys 60, the CPU 18 checks the key input (166 and 168 in FIG. 13) and, then, shifts the control to FIG. 19. Seeing that the input maintenance code is "00" (206), the CPU 18 runs a program for measuring the output voltage of the jam sensor A. As a result, the output voltage of the jam sensor A under, for example, a sheet absent condition, is applied to the CPU 18 via the ADC 204 and buffer 12 (208)**.

The CPU 18 then displays the measured voltage on the display CRT 52 (210). Simultaneously, the CPU 18 reads a predetermined reference voltage associated with an output voltage of the jam sensor A out of, in this particular embodiment, the ROM 22 so as to compare it wth the actually measured voltage, thereby deciding the normalness of the jam sensor A (212). A result of the decision is also displayed on the CRT 52 using characters and graphs.

Figure 20:
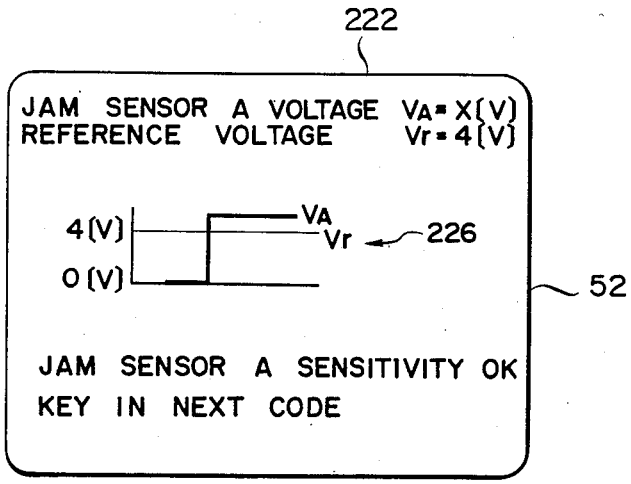
Figure 21:
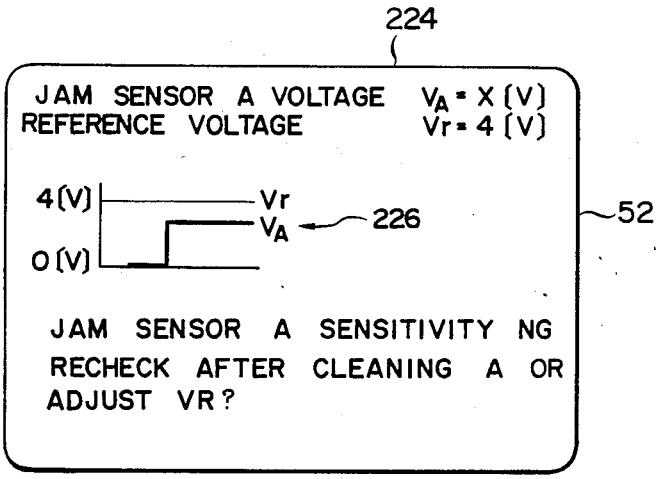

If the result is normal, a display such as a display 222 shown in FIG. 20 will appear on the CRT 52 to urge the serviceman to enter the next maintenance code (214). The serviceman then may enter another maintenance code such as "01" assigned to the other jam sensor B. If any abnormality is found, in this particular embodiment, a display 224 inclusive of instructions for urging adjustment and replacement of the variable resistor 198 as shown in FIG. 21 is produced on the CRT 52 (216).

In the illustrative embodiment, an arranement may be made in such a manner as to display voltages or other measured values in the system, for example, a waveform or other information like the analog display 226, while dititally showing it on a real-time basis (210). In such a case, the serviceman is capable of advantageously proceeding with the adjustment of the variable resistor 198 or the like while watching the analog display 226 on the CRT 52. This kind of maintenance information may also be produced as a hard copy from the copier 10 by depressing the print start key 66.

In this particular embodiment, the video data for providing the displays such as 190, 180, 224 and 222 are semipermanently stored in the graphic memory frame 28. Taking the diagnosis of the jam sensor A for example, the CPU 18 reads video data representative of, for example, the display 224 out of the memory 28 at steps 210, 212, 214 and 216. Based on the video data, the CPU 18 reads a video display pattern to generate dot patterns which are then stored in the refresh memory 40. The CRT controller 44, operating in synchronism with the timing controller 48 and clock generator 50, sequentially reads the dot patterns out of the refresh memory 40 and causes the video controller 46 to transform them into a composite video signal, with the result that the video signal appears as a display 224 on the CRT 52.

In the manner described, after the serviceman key 74 is depressed, a maintenance code or like diagnosis condition information may be entered through the ten keys 60 and the like in order to obtain on the CRT 52 a condition of a particular portion designated through the keys, a result of diagnosis, a guidance for maintenance and other maintenance data. This advantage holds true not only of voltage as shown and described but also of frequency and other factors.

In accordance with the illustrative embodiment, the device in a maintenance mode diagnoses a particular portion of the copier 10 as specified by a serviceman and provides a visible indication of the result on the CRT 52. A serviceman, therefore, is capable of smoothly proceeding with maintenance work without the need for special and independent instruments, enhancing the efficient use of the copier 10.

(IV) Inter-copier reservation guidance display

Assume that ten copiers are interlinked in a network, and that data transfer between the copiers occurs in a serial mode. Then, while a transmit copier converts parallel signals at a control section thereof to serial data by means of a shift register and transfer the serial data to the other copiers, each receiving copier converts the incoming serial data to parallel signals through a shift register and switches them to control data. When the reserve key 80 is depressed to see the current operating conditions of the copiers in the network, a key code representative of the depression is loaded in a key RAM of the display controller 36. The control ROM 22 identifies a key based on a program which is stored therein for key code discrimination. Upon depression of the key 80, the copier with the depressed key 80 turns out to be a transmit station and serially transfers status codes to the other copiers to request them to send back their operating statuses. The serial transfer is implemented by a controller installed in the device, a periodic serial transfer (USRT) LSI.

When, for example, the reserve key 80 of a copier whose registered number is "10" is depressed, this copier, copier #10, sequentially sends status codes to the other copiers, i.e., copiers #1–9, to urge them to send back their operating statuses to the copier #10. Specifically, first an ENQ (enquiry) status code notifying the copiers #1–9 of the start of data transfer is sent out, then a status code which is the data meant exclusively for the copier #1 is set between the start and end of data, and then the data are sent out serially.

The copier #1 identifies the incoming status code requesting the transfer of its operating condition to the copier #10 according to its own control program and, then, transmits an ACK (acknowledgement) code to the copier #10 informing the latter of the completion of status code reading. The coper #1 will deliver an operation status code to the copier #10 if it is in operation and a standby status code if otherwise, each in the previously mentioned transfer system.

A control program assigned to the copier #10 decides the current operating condition of the copier #1 sent back thereto according to a received signal status code decision program. The same sequence of events are repeated for each of the copiers #2–9 in this order, thereby supplying the copier #10 with the operating statuses of all the other copiers. The coper #10, upon identifying the operating statuses of the copiers #1–9, causes the CRT 18 to store in a refresh video RAM which is adapted to display on the CRT the content of a frame memory indicative of machine operating statuses. At the same time, character addresses are set in a chracter RAM which is assigned to the messages "busy" and "standby" so that characters and a graph may be displayed at the same time on the CRT 52. The addresses on the CRT 52 are updated by a CRT display period signal generated in the CRT controller 44. Then, a composite circuit included in the CRT controller 44 generates a video signal to provide the display shown in FIG. 22 on the CRT 52.

Thereafter, the operator at the copier #10 transfers a code representative of a desired nearby copier while watching the display on the CRT 52. Specifically, the operator first enters a registered code of the desired copier (e.g. "3" in the case of the copier #3) through the ten keys 60. The control ROM 44 stores a sequence program which regards a manipulation of the ten keys 60 after the display of copier operating statuses, which was provided by depressing the reserve key 80, intended for the transfer of a code assigned to a particular copier. Upon entry of the numeral "3" through the ten keys 60, the copier #10 sends the code meant for the copier #3 to the copier #3 according to the previously mentioned program.

The code assigned to the copier #3 is sent to the copier #3 by depressing the key "3" of the ten keys 60 and, then, the transfer key 81. The control program at the CPU 18 is such that it prevents the status code from being sent to the copier #3 when the transfer key 81 is depressed for the first time. Thereafter, the code meant for the copier #3 is entered through the ten keys 60; for example, the key "1" of the ten keys 60 is depressed first, then the key "1", then the key "2"; then the key "2", and then the transfer key 81 (second time).

The second depression of the transfer key is the manipulation for sending the code to the copier #3. The sequence program at the CPU 18 includes a program for determining how many times the transfer key 81 has been depressed after the reserve key 80. As the CPU 81 determines that the key 81 has been depressed two times, the code assigned to the copier #3 is set so that a status code made up of the ENQ signal, a STX signal, DATA (transfer to the copier #3 and the code assigned thereto), and an ETX in this order.

Figure 22:
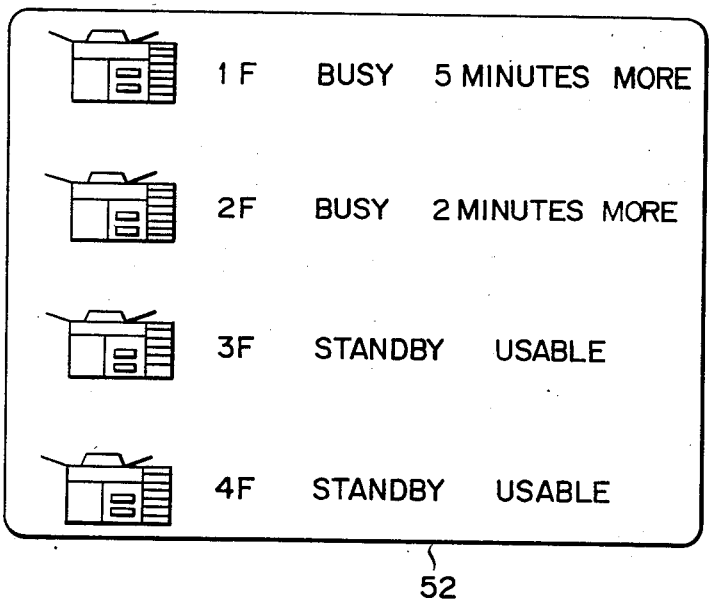
FIG. 22 is a view representative of an exemplary prompts appearing on a CRT in a reservation mode.

When the copier #10 in response to an ACK code sent back thereto from the copier #3 decides that the transfer of the reserve code has been completed and stores in the character memory the character address of a message "reserved" associated with the copier #3. Then, the CRT 52 informs the operator of the successfull reservation of the copier #3, that is, the message "standby" at 3F in FIG. 22 is replaced with a message "reserved". In the manner described, it is possible for one to reserve a nearby copier which is in a standby condition from a copier in operation, so that efficient use of multiple copiers in a network is promoted.

(V) Copier warm-up guidance display

While the guidance displays in accordance with the present invention will usually be referenced before producing copies, one is often pressed for time making it undesirable or impractical to check the guidances before starting on a copying operation. That is, the available time is so limited that one often cannot affod to start on a copying operation after confirming guidance displays to choose the most rational manner of copying, failing to make the most of the functions attainable with the present invention. In order to eliminate this problem, the present invention allows the transition of time between the instant when a main switch is turned on and the instant when a warm-up operation of a fixing heater is completed to be displayed automatically as a guidance in a guidance display mode, thereby teaching a user who is awaiting the end of the warm-up operation the most rational way of using the copier and the like.

Figure 23:
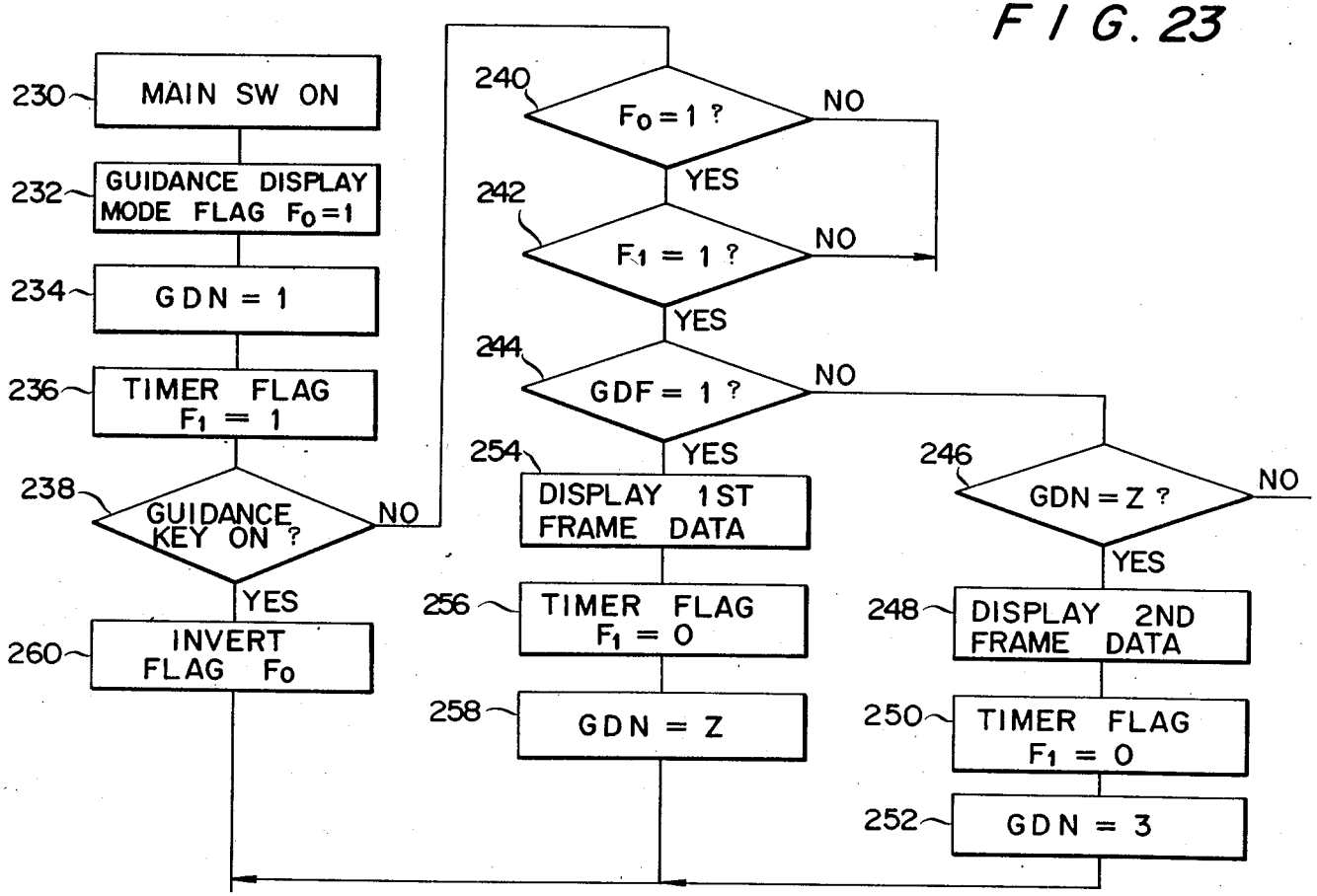
FIG. 23 is a flowchart demonstrating the operation associated with the reservation mode guidance shown in FIG. 22.

Referring to FIG. 23, there is shown part of a control flowchart for practicing the illustrative embodiment, starting at a point just after a main switch has been turned on (230). First, a guidance display mode flag $F_0$ is automatically (232) set and, then, a guidance display frame no. GDN=1 is set (234). Next, a timer flag $F_1$ is set (236) for switching the frame at predetermined intervals, so that the first guidance display can be provided. Whether the guidance key has been depressed is determined to see if the operator desires guidance displays (238); every time the guidance key is depressed, the guidance display mode flag $F_0$ is inverted (260).

At the instant of depression of the main switch, the flag $F_0$ is automatically made $F_0=1$. So long as $F_0=1$ is maintained due to the lack of depression of the guidance key, the guidance display switches from one to another at predetermined intervals. That is, if the answer to the question "guidance key on" is NO, $F_0=1$ is checked for confirmation (240) and, then, the timer flag $F_1=1$ is checked to see if a display switching time has been reached (242). When the main switch is "on" which automatically sets up $F_1=1$, data in GDF=1 are immediately converted and displayed. As a one full frame of data have been displayed, the timer flag $F_1$ is reset to start counting time again and, simultaneously, the GDF number is incremented. If desired, the frame may be manually switched through a special key installed in the control section. Then, the decision (242) of $F_1=1$ in FIG. 23 will be replaced with that of whether such a special key has been depressed.

It will be understood from the above that in accordance wit the illustrative embodiment an operator of a copier is allowed to reference guidance displays utilizing a warp-up time and, thereby, to acquire the outline, operating method and the like particular to the copier without resoring to any additional and exclusive time.

(VI) Binding margin setting guidance display

In a copier, a copy sheet is usually provided with a several millimeters of blank (non-image) region at each of its front, rear, right and left ends for the purpose of enhancing separation, erasing shadows of a document, and other purposes. Moreover, a modern copier is designed to intentionally provide a 10–20 millimeters of blank area at the front or rear end of a copy sheet. Such an intentional blank area is accomplished by erasing the area which is expected to provide a binding margin or by shifting the transport timing of a transfer sheet. In any case, however, whereas copy sheet is provided with such a blank area, it is apt to loose essential information carried in a front or rear end portion of a picture corresponding to the blank area. This stems from the fact that it is impossible to known the dimension of a blank area beforehand or, if a binding margin is set beforehand, it is displayed in numerals only and makes it impractical to see which part of a document will be lost and how much.

Figure 24:
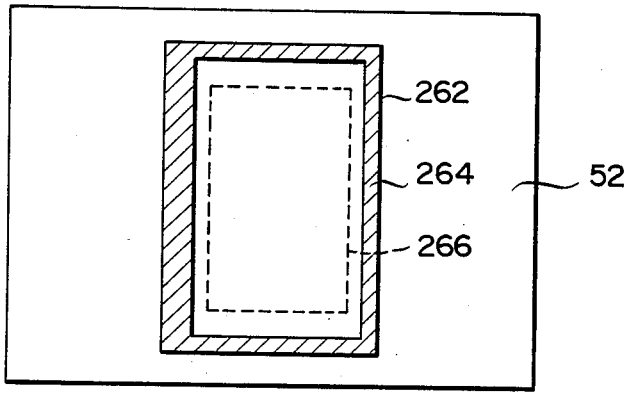
FIG. 24 is a view representative of an exemplary prompts appearing on a CRT and associated with binding margins of copy sheets.

In light of the above, in accordance with this particular embodiment, non-image regions (blank width) are displayed on the CRT so that a desired binding margin may be selected while selecting a magnification which will not interfere with picture information. That is, a picture in which a binding margin is to be set appears on the CRT 52 as shown in FIG. 24. In FIG. 24, the frame labeled 262 represents a size of transfer sheets, the hatched area labeled 264 represents a non-image region which may be used as a binding margin, and the frame labeled 266 represents a picture area in which a picture of an original document will be actually reproduced. The operator first selects a sheet size (such as a format A4), through a sheet size select key (not shown) on the control panel 54 and, then, enters a desied width of a binding margin. The CRT 52 displays the width of the binding margin in numerals and, at the same time, graphically displays inside the sheet size 262 a blank area complementary to the entered binding width together with the other blank regions (front, rear, right and left erased regions). In this condition, the operator enters a suitable magnification through one of the magnify keys 70 and the ten keys 60 so that the whole picture on the document is confined to the effective picture area on the CRT 52. This provides on the CRT 52 actual dimensions of a picture to be reproduced on the basis of the entered magnification and document size. If the copy size 266 is excessively large and invades the blank areas 264 or excessively small, any other suitable magnification may be selected through the magnify keys 64 and ten keys 60.

In the manner described, where non-image (blank) regions are graphically shown on the CRT 52, one can see an effective image area at a glance and, therefore, select a magnification which causes no loss of image information. In short, the procedure described above frees an operator from incomplete copies due to selection of an improper magnification.

(VII) Magnification setting guidance display

In a copier to which the present invention is applied, a magnification is usually selected by manipulating the magnify keys 64 and ten keys 60 arraned on the control panel 54. An operator is free to choose a magnification and, so long as the operator chooses any of fixed magnifications which are usually used with standardized sheet formats, it is insured that the reproduced picture is free from any discontinuity of image. However, when it comes to sheet sizes other than a standardized size or, if the sheet size is standard, when the operator selects an arbitrary magnification, he or she cannot readily imagine a picture size which will result from the selected magnification. It has been customary, therefore, to produce some test copies at a desired magnification and set another magnification if the result is undesirable, thereby wasting transfer sheets.

Figure 25:
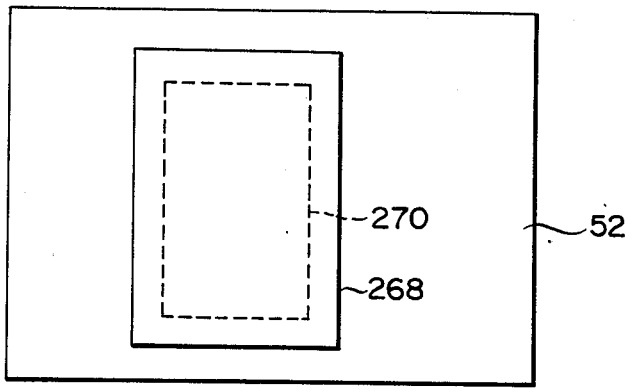
FIG. 25 is a view representative of an exemplary prompts appearing on a CRT and associated with magnifications.

To cope with the above situation, the illustrative embodiment is constructed to eliminate incomplete copies due to choice of an improper magnification by graphically displaying a copy size on the CRT 52 in the event of a copying mode wherein the magnification is continuously changed (zooming). As shown in FIG. 25, the CRT 52 on the control panel 54 displays thereon a transfer sheet size 268 and a size 270 of a picture to be reproduced which is determined based on a document a size and a magnification. The operator can thus see the size of a picture associated with any desired magnification as well as a size of transfer sheets, avoiding incomplete copies due to the choice of an improper magnification.

As described above, one is allowed to see a relationship between a desired picture size and an actual transfer sheet size beforehand by watching a copy size associated with a particular magnification on the CRT 52. This precludes the possiblity of selection of an inadequate magnification which would result in incomplete copies.

(VIII) Guidance display for sensing copier ambience

Supplies used with a copier such as paper sheets, developer and photoconductive element are susceptive to ambient temperature and humidity and, therefore, optimum copies are unattainable unless the copier is operated under ambient conditions which lie within a certain allowable range. However, when a copier is used in the early morning in winter or during a rainy season, for example, the ambient conditions surrounding the copier often depart from the allowable range resulting in faulty copies, sheet jams and other failures. That is, despite that ambient conditions for use are predetermined, prior art copiers have been furnished with no implementation for sensing the ambient conditions or producing an alarm in response to sensed conditions, thus failing to provide optimum copies and often causing paper jams.

Figure 26:
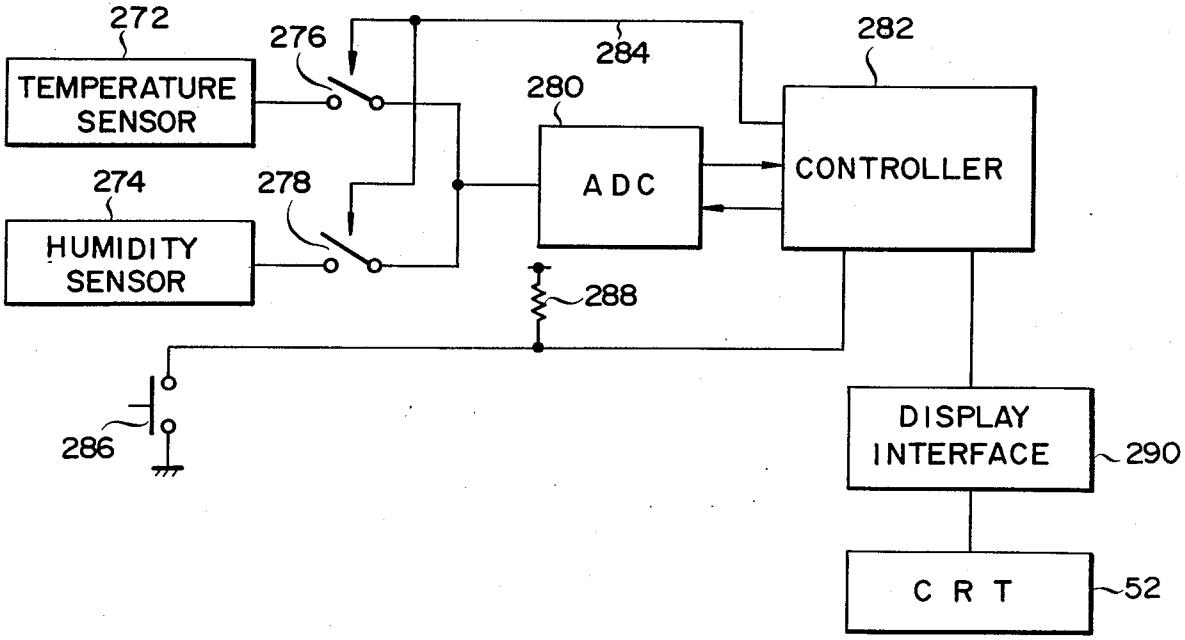
FIG. 26 is a block diagram of a controller adapted to display on a CRT a guidance associated with the ambience surrounding the copier.

To solve the above problem, the illustrative embodiment of the present invention is constructed to sense and display ambient conditions surrounding a copier and, when the sensed conditions do not lie in a particular range, produces an alarm, thereby freeing the copier from incomplete reproduction and other undesirable occurrences. A control circuitry for implementing such an objective is shown in FIG. 26. The control circuitry comprises a temperature sensor 272, a humidity sensor 274, analog switches 276 and 278 adapted respectively to switch analog signals output from the sensors 272 and 274, an analog-to-digital converter (ADC) 280 for converting an analog output of the temperature sensor 272 or that of the humidity sensor 274, and a controller 282 responsible for a specific control over the guidance display. A signal line 284 extends from the controller 282 to the switches 276 and 278 for controllably connecting the outputs of the sensors 272 and 274 to the ADC 280. The circuitry also includes a cancel key 286 which will be described, an input pull-up resistor 288, an interface 290 for displaying display data output from the controller 282 on the display 52.

Output signals of the temperature sensor 272 and humidity sensor 274 are selectively routed to the ADC 280 via the analog switches 276 and 278, which are controlled by the controller 282 via the line 284. The output of the ADC 280 is applied to the controller 282. So long as the temperature and humidity read by the controller 282 remain each in a predetermined range, they are displayed on the CRT 52 via the display interface 290 as shown in FIG. 27. If they exceed the individual predetermined ranges, e.g., a range of 10° C. to 30° C. for temperature and a range of 30% to 90% for humidity, the controller 282 displays alarm messages on the display 52 as shown in FIG. 28.

The display shown in FIG. 28 represents a case wherein the temperature is lower than 10° C. and indicates a fear of contamination to the background of copies due to excessively low temperature of a photoconductive element, while restraining the use of the copier. However, if the operator decides that contamination to the background is compromizable, he or she may depress the cancel key 286 to cancel the restraint.

When the humidity is higher than 90%, a display such as shown in FIG. 29 will appear on the CRT 52. This time, the display indicates the possibility of paper jams due to the high humidity. In short, both the displays in FIGS. 28 and 29 provide visible indications of inhibitive temperature and humidity ranges at the same time, so that one readily sees the current ambient conditions end that the are out of the allowable ranges.

As described above, the display of instantaneous ambient conditions surrounding a copier allows one to grasp at a glance whether the copier is operable under optimum conditions. When the current ambient conditions do not lie within the predetermined ranges, an alarm is produced and the operation of the copier is restrained to thereby eliminate incomplete copies and others. If one is pressed for time and may decide to accept that copies may not be optimum, he or she may operate the copier by cancelling a copy restraint mode.

(IX) Cautions guidance display while copier is not used

From the anti-disaster and anti-crime standpoint, it will be helpful to display cautions which should be exercised while the copier is not used or when the operator leaves the room after turning off the main switch of the copier after the day's use, thereby keeping the conditions of the copier and others optimum. A control circuitry for providing such a display is shown in FIG. 30.

Figure 30:
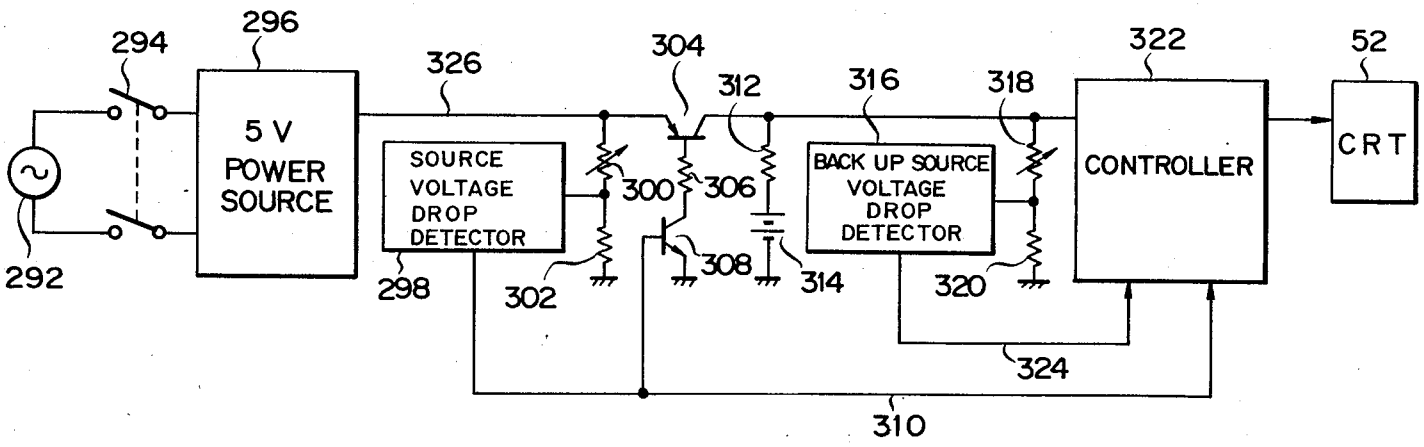
FIG. 30 is a diagram of a controller adapted to display on a CRT various messages while the copier is put out of use.

Referring to FIG. 30, there are shown a commercial power source 292 such as a.c. 100 V, a main switch 294 of a copier, a power source 296 such as 5 V, a source voltage drop detector 298, a variable resistor 300 and a resistor 302 cooperating to apply a source voltage to the source voltage drop detector 298, a p-n-p transistor 304 for switching a backup power source 314 and the power source 296 from one to the other, a resistor 306 and an n-p-n transistor 308 cooperating to turn on and off the transistor 304 in response to an output 310 of the detector 298, a resistor 312 for limiting the current flowing through the backup power source 314, which is free to charge and discharge, a source voltage drop detector 316 associated with the backup power source 312, a variable resistor 318 and a resistor 320 adapted in combination to apply a backup source voltage to the source voltage drop detector 316 as an input signal, a controller 322, an output signal 324 of the source voltage drop detector 316, and a power source line 296 associated with the power source 296.

When the main switch 294 is turned off causing the source voltage (e.g. 5 V) to start dropping, the source voltage drop detector 298 detects a drop of the source volgage beyond a predetermined level. The output 310 of the detector 298 turns off the transistor 304 by way of the resistor 306 and transistor 308, thereby switching the active power source from the power source 296 to the backup power source 314. At the same time, the output 310 is routed to the controller 322. Then, the controller 322 deactivates the load of the copier body and, then, starts on a display control which is to follow the turn-off of the main switch 294. As the display is executed and the voltage of the backup power source 314 begins to drop, the source voltage drop detector 316 responds to the voltage drop by signalling the controller 322 with its output 324. Then, the controller 322 resets the display and itself.

Assuming that the threshold levels assigned to the source voltage drop detectors 298 and 316 for detection purpose are $V_{298}$ and $V_{316}$, respectively, there needs be satisfied a relation:

$$5 > V_{298} > V_{316}$$

It is also required that the threshold level $V_{316}$ be a voltage up to which the controller 322 can operate without malfunctioning. Meanwhile, the capacity of the backup power source 314 is preselected such that the source switches from $V_{298}$ to $V_{316}$ after a certain period of time which is long enough for the operator to fully confirm a specific display on the CRT 52 which follows turn-off of the main switch 294, e.g. longer than 5 seconds.

Figure 31:
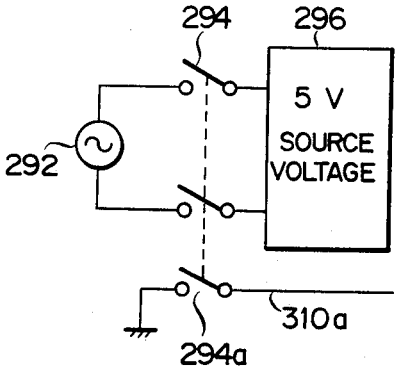
FIG. 31 is a block diagram of a source voltage detector of FIG. 30.

Another specific construction of the source voltage drop detector 298 responsive to turn-off of the main switch 294 is shown in FIG. 31. In FIG. 31, the main switch 294 itself is provided with a submain switch 294*a* which includes a circuit connecting to ground, in addition to the circuit for cutting off the power source line. The circuit connecting to ground produces an output 310*a*.

Figure 32:
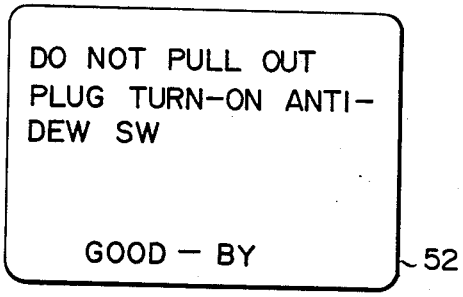
FIGS. 32–33 are views representative of exemplary guidances on a CRT associated with the controller of FIG. 30.
Figure 33:
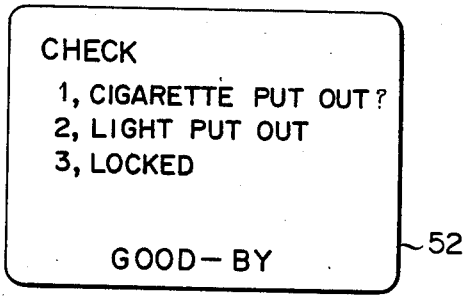

Examples of messages which may be displayed after the main switch is turned off are shown in FIGS. 32 and 33. In a copier of the type having a dew-preventing heater, temperature control heater or the like, a plug of the copier should not be pulled out of the socket. Such may be included in the messages as shown in FIG. 32 by way of example. However, in the case where the dew-preventive heater is of the manually operated type, the display will include a message which urges the operator to manipulate it. When the operator is about to leave the room, a precautionary display for the prevention of disasters and crimes may be provided as shown in FIG. 33. The messages shown in FIGS. 32 and 33 are displayed either singly or in combination as the case may be.

As described above, cautions which should be taken while the copier is not used are displayed after the main switch of the copier has been turned off, thereby optimizing the conditions of the copier for future use. The display of cautions appearing when the operator is about to leave will constitute an effective disaster- and crime-preventing measure. Further, since the display is turned off as a predetermined time elapses, there is no need to install an exclusive switch for the display.

While displays in some guidance modes have been shown and described, the illustrative embodiment of the present invention allows one to freely use various keys and others to easily control the copier in any of the guidance modes as instructed by messages appearing on the CRT 52.

Figure 34:
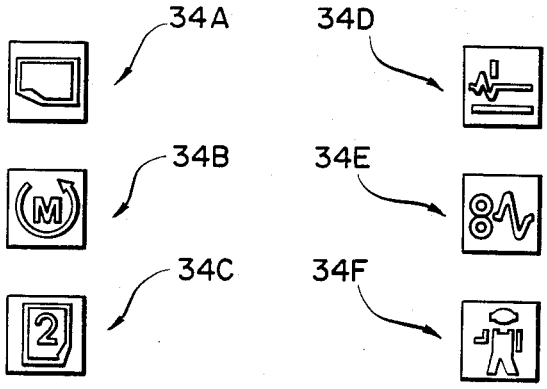
FIGS. 34–37 are views representative of character and graphic information which may appear on a CRT as guidance prompts.

Referring to FIGS. 34–37, there are shown some examples of characters and graphs which may be displayed in part of the CRT 52 for guidance. FIG. 34 shows pictorial symbols which are extensively used in various fields due to their outstanding legibility. The following explanations are associated with the respective pictorial symbols which are shown in FIGS. 34A–34F:

Symbol 34A: SUPPLY PAPER
lights when sheets are used up. Pull out paper tray indicated by glowing lamp, and supply sheets.

Symbol 34B: ROLL UP MASTER
Depress master roll-up key in internal monitor when flashed.

Symbol 34C: CHECK TWO-FACE SET NUMBER
lights if the set copy number in a multi-mode two-face operation is excessive. Check the set copy number.

Symbol 34D: DOCUMENT MISFEED
lights when a document is misfed.

Symbol 34E: MISFEED
lights when a sheet is misfed. Locate misfeed in the internal monitor, and remove.

Symbol: 34F: CALL SERVICEMAN
lights when in need of serviceman's help and shows a failed section by number. Contact a serviceman.

Figure 35:
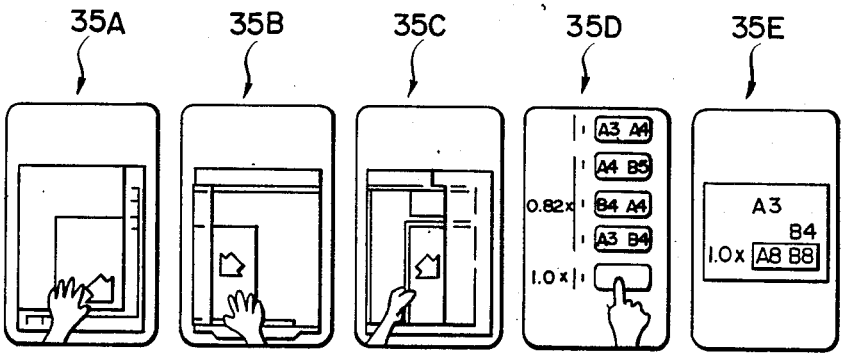

FIG. 35 shows a rational way of using a copier when a sorter is used with the copier. Since the display screen is too small to display the whole procedure, there is also displayed a message "continued". 35A in FIG. 35 represents a normal condition, 35B a condition in an ADF mode, 35C a condition in a SADF mode, 35D a condition with x1 magnification and a reduction key turned on, and 35E confirmation of a sheet size.

Figure 36:
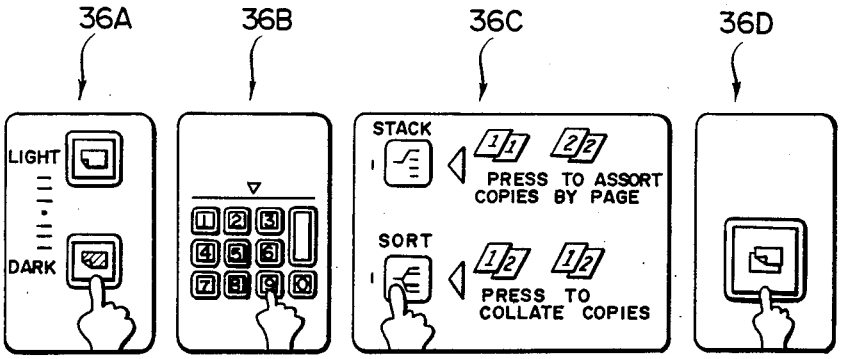

FIG. 36 shows displays which are the continuation of the guidances associated with a sorter. In FIG. 36, 36A represents adjustment of density, 36B copy number setting, 36C turning on of a sort stack key, and 36D turning on of a print start key.

Figure 37:
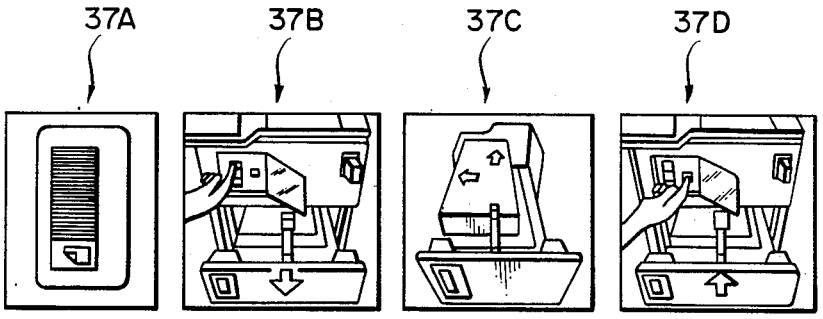

FIG. 37 shows a sequence of guidances which may appear to instruct a method of supplying sheets. 37A–37D in FIG. 37 are assisted by the following explanations:

37A: Confirm number of tray specified by paper feed display.

37B: Unload the tray by depressing key bearing the confirmed number.

37C: Set sheets forcing them against left deepest point, and abut guide lever against the sheets.

37D: Load the tray by depressing key (indicated by a pictorial symbol)

In summary, it will be seen that the present invention provides a guidance device which when one manipulates desired keys displays guidances which are representative of their functions. The device, therefore, allows one to readily master the various functions assigned to the respective keys and, thereby, freely use all the available capabilities of a machine with ease, eventually contributing to enhancement of the operationability of the machine.

While the guidances have been shown and described as being represented by still pictures, they may be replaced with animations. The guidances may be provided only in characters with no illustration. Furthermore, the visible displays may be replaced with or assisted by a voice synthesizing function or a voice storing function in order to produce audible guidances.

It will be apparent that the present invention is applicable not only to copiers but also to various other machines such as facsimile apparatuses and printer.

Various modifications will become possible for those skilled in the art after receiving the teachings of the present disclosure without departing from the scope thereof.

What is claimed is:

1. A device for guiding the manipulation of a machine, said machine having multiple keys to which various functions are assigned, comprising:

first sensor means for sensing a condition in which the machine needs a maintenance operation;

second sensor means for sensing a mounting condition of movable elements included in said machine;

display means for displaying prompts which specify a procedure of the maintenance operation;

storage means for storing displays of the prompts associated with the first sensor means; and control means for controlling said storage means and display means in response to outputs of the first and second sensor means;

said control means being constructed to, when the first sensor means senses said condition of the machine, read displays of the prompts associated with said condition out of the storage means to display said prompts on the display means and, thereafter, sequentially read out displays of the prompts associated with the second sensor means to display said prompts on the display means in response to an output of the second sensor means and, upon completion of the steps indicated by said displayed data, provide prompts of additional steps in the process of operating said machine.

2. A device as claimed in claim 1, wherein the display means comprises a graphic display for displaying the prompts using characters and graphs.

3. A device for guiding the manipulation of a machine, said machine having multiple keys to which various functions are assigned, comprising:

first specifying means for specifying a diagnostic mode during which a portion inside the machine is to be diagnosed;

second specifying means for specifying a portion to be diagnosed during the diagnostic mode;

control means for diagnosing a condition of the portion specified by said second specifying means; and display means controlled by said control means for displaying maintenance information;

said control means being constructed to, when the first specifying means is manipulated, diagnose the portion specified by the second specifying means to display maintenance information associated with said portion on the display means wherein the maintenance information includes a display of the condition of the diagnosed portion and wherein, in response to the diagnosed condition's being unacceptable, instructions for the maintenance of said device are provided and further wherein, in response to an acceptable diagnosis, instructions for proceeding with a next step in the diagnosis of said device are provided.

4. A device as claimed in claim 3, wherein the machine to be diagnosed comprises a copier, the maintenance information including a voltage and a waveform appearing in a detector inside the copier, and reference conditions of said voltage and waveform, and means for printing the information detected.

* * * * *